US005134958A

United States Patent [19]

Zimmer

[11] Patent Number: 5,134,958

[45] Date of Patent: Aug. 4, 1992

[54] DOCTOR APPARATUS FOR APPLYING FLUID MATERIAL TO A SUBSTRATE

[76] Inventor: Johannes Zimmer, Ebentaler Strasse 133, 9020 Klagenfurt, Austria

[21] Appl. No.: 469,561

[22] PCT Filed: May 18, 1988

[86] PCT No.: PCT/EP88/00433

§ 371 Date: Apr. 9, 1990

§ 102(e) Date: Apr. 9, 1990

[87] PCT Pub. No.: WO89/03248

PCT Pub. Date: Apr. 20, 1989

[30] Foreign Application Priority Data

| | | | |
|---|---|---|---|
| Oct. 10, 1987 | [EP] | European Pat. Off. | 87730126.7 |
| Oct. 10, 1987 | [EP] | European Pat. Off. | 87730128.3 |
| Oct. 10, 1987 | [DE] | Fed. Rep. of Germany | 3734747 |
| Oct. 10, 1987 | [DE] | Fed. Rep. of Germany | 8713788[U] |
| Oct. 10, 1987 | [DE] | Fed. Rep. of Germany | 8713789[U] |

[51] Int. Cl.[5] ..... B05C 11/04

[52] U.S. Cl. ..... 118/119; 118/122; 118/123; 118/124; 118/126; 118/413; 118/414; 118/419

[58] Field of Search ..... 118/110, 118, 119, 122, 118/126, 244, 248, 249, 213, 406, 413, 414, 419, 203, 121, 123, 124; 101/119, 120

[56] References Cited

U.S. PATENT DOCUMENTS

| | | | |
|---|---|---|---|
| 2,330,834 | 10/1943 | Meyer et al. | 91/33 |
| 2,372,248 | 3/1945 | Bouton | 118/103 |
| 3,216,349 | 11/1965 | Kraft | 101/120 X |
| 3,592,132 | 7/1971 | Weber | 101/119 |
| 3,878,780 | 4/1975 | Lotte | 101/119 |
| 4,031,823 | 6/1977 | McGee | 101/120 |
| 4,063,531 | 12/1977 | Zitzow | 118/122 |
| 4,655,723 | 5/1987 | Zimmer | 101/120 X |
| 4,728,539 | 3/1988 | Gane | 118/103 |
| 4,940,013 | 7/1990 | Zimmer | 118/62 |

FOREIGN PATENT DOCUMENTS

| | | |
|---|---|---|
| 1760210 | 1/1958 | Fed. Rep. of Germany . |
| 1958912 | 11/1969 | Fed. Rep. of Germany . |
| 3436371 | 10/1984 | Fed. Rep. of Germany . |
| 8002400 | 11/1980 | PCT Int'l Appl. . |

*Primary Examiner*—Michael G. Wityshyn
*Attorney, Agent, or Firm*—Fay, Sharpe, Beall, Fagan, Minnich & McKee

[57] ABSTRACT

A doctor for the application of fluent material to a substrate (8), such as a material web has a pressing part (3) extending in the longitudinal direction of the application apparatus (application width), which comprises a working edge (30) passing over the application width (7), an actuator on the pressing part (3) along the working edge (30) and movable by means of a magnetic field, comprising at least one electromagnet and/or permament magnet (20), which together with the pressing part (3) forms a pressing unit (4).

24 Claims, 3 Drawing Sheets

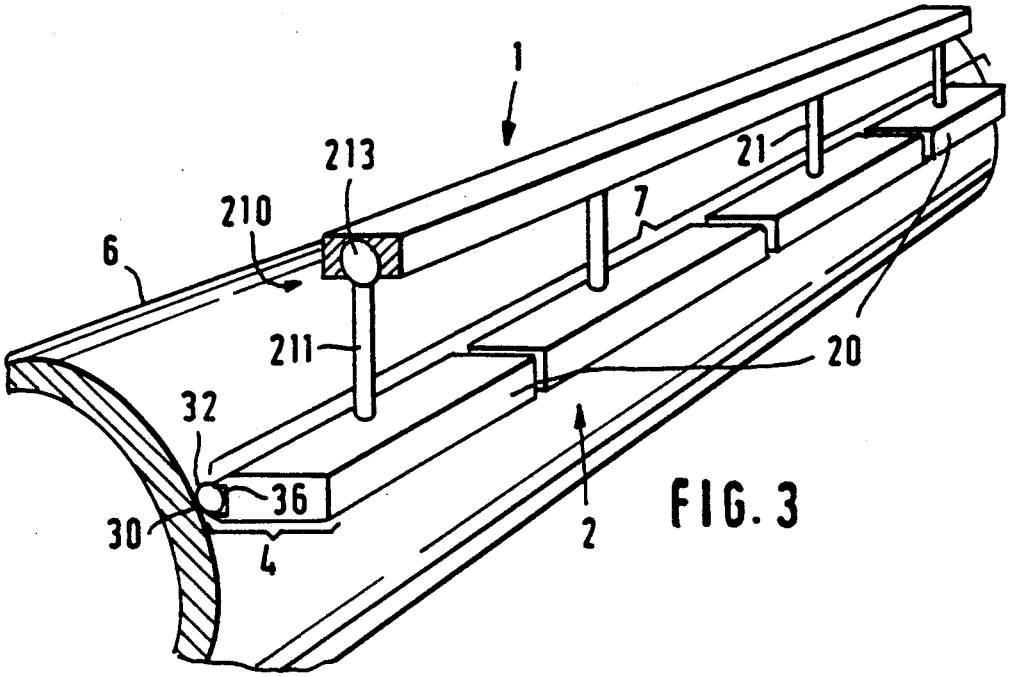
FIG. 3
FIG. 4
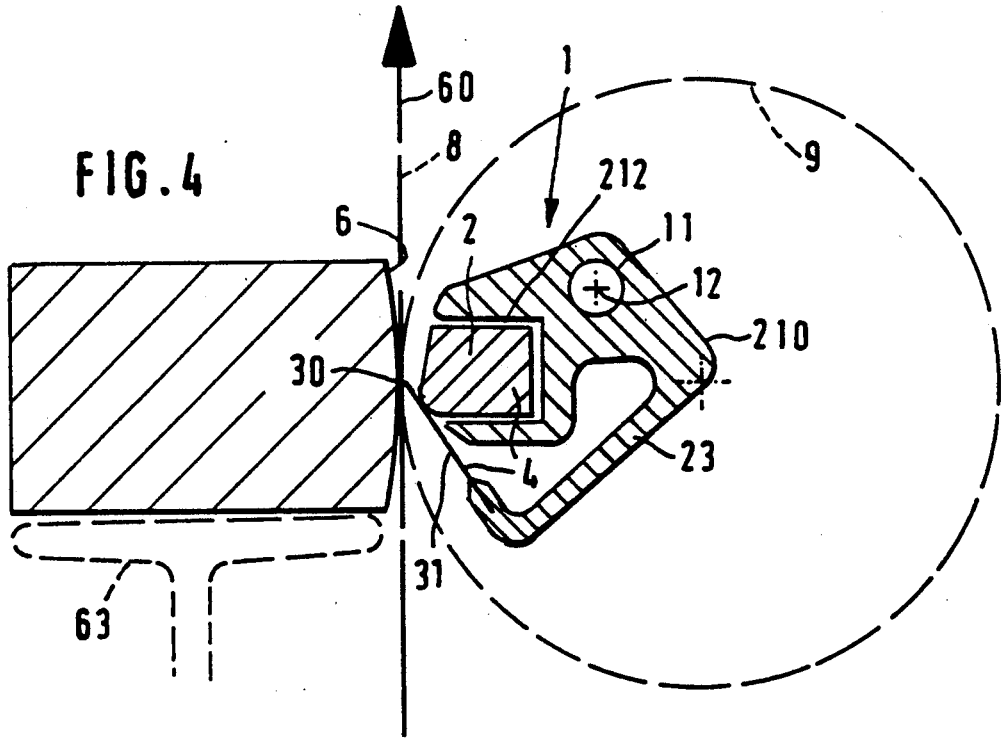

DOCTOR APPARATUS FOR APPLYING FLUID MATERIAL TO A SUBSTRATE

BACKGROUND OF THE INVENTION

The invention relates to an apparatus for applying fluent material, such as optionally foamable substances of differing viscosity, coating substances, varnishes, adhesives, pastes, etc., to a substrate, such as a web of material. The material is applied with a pressing part that engages a substrate with a magnetic device for operating the pressing part. Such an apparatus is used for flat stencil printing, round stencil applications and/or for stencil-free, full-surface applications. The application width of the pressing part can be several meters. As a function of the intended use, it is possible to carry out patterning applications (printing) and/or full-surface applications (e.g. impregnation, coating, dyeing, varnishing).

Squeegee devices are known (DE-AS 1 135 856), in which a magnetizable doctor can be magnetically pressed against a magnetic beam or bar extending with the doctor below and along the substrate path. It is also known to provide on the back of a sheet spreading doctor a magnetizable strip fixed to the doctor over the application width, so that by means of the strip the doctor can be pressed against a substrate by the magnetic force of a magnetic beam or bar (DE-OS 34 19 590). In yet another squeegee device (DE-OS 25 44 784), a squeegee or doctor roller can be magnetically pressed onto the back of a separately arranged profile strip spaced from the rolling surface of said roller. It is always necessary for the magnetic pressing of the doctor within a printing press to provide a machine-stationary magnetic beam, which is optionally connected via a machine frame to the bearing of the doctor. The magnetizable mass of the doctor or a support part non-detachable connected in one-piece manner thereto must be designed in accordance with the size of the desired magnetic force to be produced. This leads to relatively large application machines, which must be specially designed for each application type and must be designed and constructed with adapted components.

SUMMARY OF THE INVENTION

The task of the present invention is to provide a particularly simple and compact, easily handlable and universally usable application apparatus with a pressing part (coating profile), which is to be usable as a constructional unit with a random desired coating profile. In simple manner it must be possible to position the constructional unit on any substrate path along a magnetizable body.

In conjunction with the features of the aforementioned application apparatus, this problem is solved in that the magnetic device has at least one electromagnet and/or permanent magnet placed on the pressing part that together with the latter forms a pressing unit. The application apparatus comprises a holding part for holding the magnetic device that is movable in the direction of the substrate path under magnetic attraction against a magnetic or magnetizable body with at least one edge of the pressing part passing over the application width. The application apparatus according to the invention forms a compact pressing unit, which can be installed as an easily handlable component at any desired place of use. Machines can easily be reequipped with such a pressing unit, said machines guiding or holding a substrate to be printed or coated such as a material web or any other flat part to be treated on or at a magnetizable support member. In machines intended exclusively for applications, the pressing unit forms a universally usable, compact machine component leading to a considerable simplification of the construction of such machines. An important characterizing feature of the invention is that the pressing part is an integral component of a unit producing a magnetic force. This constructional unit comprises as such the essential elements necessary for an application, so that essential functions can be combined into a single apparatus. The desired doctor profile is provided by a pressing part. An electromagnet and/or permanent magnet device is located directly on the pressing part and produces the desired pressing force and the bearing part holding the magnetic device ensures the desired spatial orientation and/or positioning of the pressing part for setting or adjusting the desired application result.

An important configuration of the application apparatus according to the invention comprises the magnetic device being subdivided lengthwise into at least two segments strung together in link-like manner and forming electromagnets or permanent magnets. Preferably, at least one segment located on the side of the substrate path is placed on the bending elastic pressing part in the extension direction. Such an apparatus is in particular characterized in that, whilst avoiding the inherent rigidity of conventional components extending over several meters, a constructional unit with a large application width is obtained, which even in the case of a relatively limited pressing force and a construction having optional electromagnets/permanent magnets with a relatively large cross-section, ensures uniform width application results. The segmental structure of the magnetic device has a bending-slack characteristic over the entire application width, which leads to an excellent adaptation and matching of the bending elastic pressing part subject to the action thereof on the magnetizable support member carrying or guiding the substrate. The pressing part is preferably in the form of a coating blade, a thin coating bar or a small cross-section coating strip. It is interchangeable so that after wear to a pressing or doctor edge, it can be machined by regrinding. The pressing-doctor profile elements can be made from a bending-adaptable, metallic material, as well as e.g. plastic, glass, ceramic material or a combination of such materials. The deformation resistance of the pressing unit is relatively small over the working width compared with the pressing forces. Cross-sections of the magnetic device and pressing part, the overall modulus of elasticity in the longitudinal direction and the working width are particularly favourably matched to one another. If necessary, each electromagnet segment can be individually electrically controlled, so that there is optionally a differentiated local control of the pressing action over the application width. The pressing unit with segmental electromagnets is particularly appropriate for fitting or reequipping machines, which transport parts or goods along a magnetizable surface and which have a substrate to be printed or coated.

The pressing unit can in very advantageous manner be constructed in combination with a mounting support, which movably articulates in transverse direction to the longitudinal extension of the application apparatus. It is particularly appropriate for the mounting support to be constructed in the form a pivot bearing and/or a clearance fit.

According to a special construction of the invention the magnetic device or optionally each segment arranged on the pressing part and whilst engaging on the pressing element is positioned so as to be movable relative thereto, the pressing element being constructed as a coating doctor blade arranged on a mounting support. This leads to a particularly good bending elasticity of the coating doctor blade in the longitudinal direction of the apparatus.

According to a further variant of the application apparatus according to the invention, the pressing part is constructed as a magnetizable roll doctor (metering rod), which is held in freely rotatable manner in at least one recess provided on the magnetic device or optionally on juxtaposed, lined-up segments positioned along the application width. As thin profile bars, such roll doctors can be very easily replaced, but can still be handled in unitary manner with the magnetic device.

According to another variant of the application apparatus according to the invention, a recess is arranged on the magnetic device along the application width and which forms with its edges two through, parallel pressing parts. Such a recess forms a gap for an air knife located on a magnetizable countermember and which engages therein. Thus, the application apparatus can be advantageously constructed together with such a counterengagement member.

Application apparatuses according to the invention with identical pressing devices, more particularly constructed in mirror symmetrical manner to the substrate path, lead to very simply constructed application apparatuses performing two-sided applications.

BRIEF DESCRIPTION OF THE DRAWINGS

Further developments, variants and embodiments of the invention can be gathered from the subclaims and the following description relative to the drawings.

FIG. 3 is a perspective view of an application apparatus according to the invention with a magnetic device subdivided into permanent magnets or electromagnets over the application width.

FIG. 4 is a cross-sectional view of an application apparatus according to the invention with a magnetic device loosely arranged on a sheet spreading doctor.

DETAILED DESCRIPTION

Figure 1:
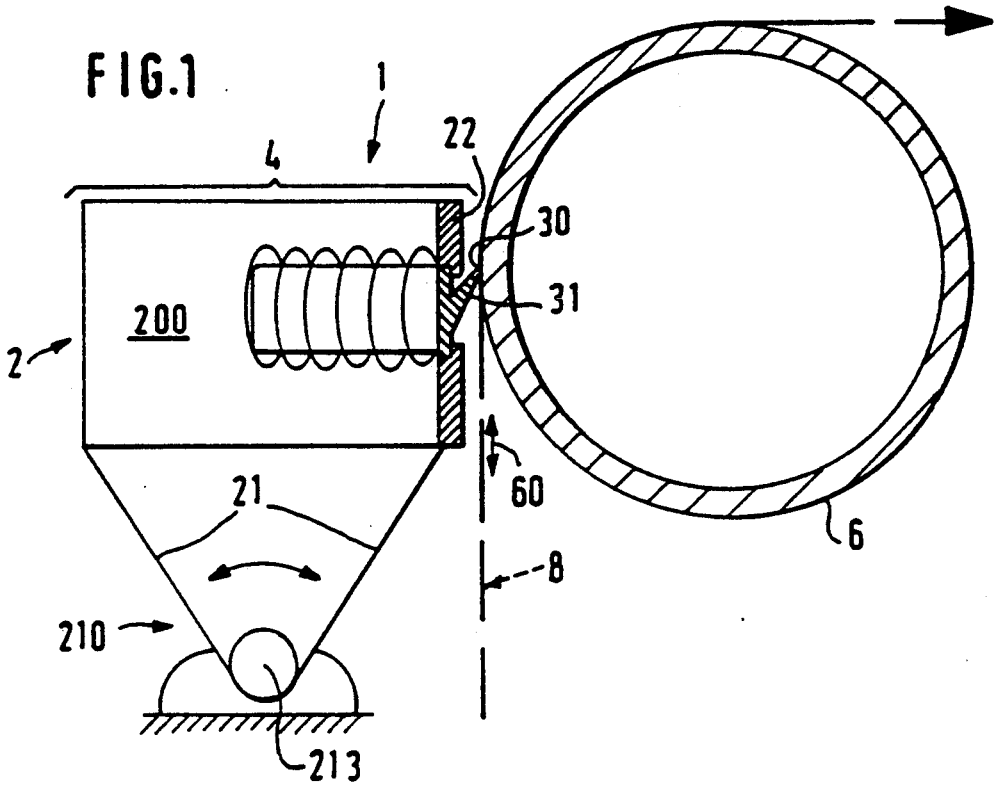
FIG. 1 is a cross-sectional view of an application apparatus according to the invention with a segmented electromagnet device.

Each application apparatus 1 is provided with at least one working or doctor edge 30 of at least one pressing part 3 arranged on the apparatus for acting on a substrate web 8 over the length 7 (application width) of the apparatus. By means of a doctor 31, 32, 35 forming a pressing part 3 and through a relative movement of the doctor to the substrate path 8, a substance 5, optionally by means of a patterning stencil 9 is applied to the substrate web 8. The latter can be guided or held on a bearing surface 6, for example a magnetizable body.

In FIG. 1 an application apparatus 1 according to the invention comprises a magnetic device 2, which is connected to a pressing part 3 in the form of a coating or spreading doctor 31. The magnetic device 2 and the pressing part 3 form a pressing unit 4. To the magnetic device 2 is fixed a mounting or holding part 21, which is mounted on a mounting support 210. The pressing unit 4 is pivotable about an axis 213 parallel to the length of the apparatus 1.

The magnetic device 2 is constructed with a plurality of electromagnets 200 juxtaposed over the longitudinal direction of the apparatus 1. These magnets are placed on a holding web 22 extending over the longitudinal direction of the apparatus and which is constructed in the form of a thin plate and compared with the cross-sections of the electromagnets 200 is relatively small and therefore bends elasticly. The magnetic device 2 is consequently subdivided into several segments 20, so that it also has a relatively large bending elasticity in the longitudinal direction of the apparatus 1. The pressing part 3 which also extends over the application width can be part of the holding web 22 or can be interchangeably fitted into a slot thereof. The holding web 22 and/or the pressing part 3 can be advantageously connected by plug-in or screw connection to the juxtaposed electromagnet segments 20.

According to another variant the holding web 22 and/or the pressing part 3 can also form a component of a strip or a frame body carrying the juxtaposed electromagnets 200.

The pressing unit 4 is arranged over the application width along a rotating or stationary steel roller, particularly a magnetizable body 6, which is in turn part of any conveying machine for a substrate web 8 or other substrate parts to be printed or coated. On switching on the electromagnet segments 20, edge 30 is pressed in the direction of the machine-stationary roller 6 by a magnetic pressing action. It is in particular possible to supply the electromagnet segments 20 with a different voltage in each case, so as to achieve a different pressing action over the application width due to the segmentation. Each electromagnet segment 20 with the holding part 21 is articulated so as to be individually pivotable.

Figure 2:
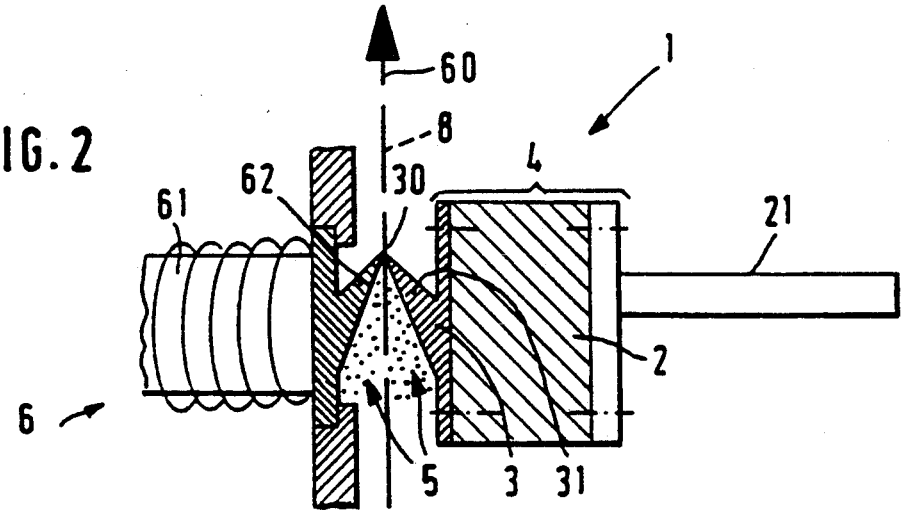
FIG. 2 is a cross-sectional view of an application apparatus according to the invention with a segmented electromagnet device, which is provided together with a magnetizable countermember for a two-sided coating profile application.

An application apparatus 1 shown in FIG. 2 comprises a pressing unit 4 corresponding to that of FIG. 1. On a substrate path 60 is provided on the side opposite to the pressing unit 4 a magnetizable body 6 extending over the application width and which is provided with a holder, particularly a machine stationary magnetic beam, 61 in a not shown machine. The body 6 is connected e.g. by means of a screw or plug-in connection to a coating doctor 62. The working edges of the two coating doctors 31, 62 work against one another, accompanied by the formation of a wedge-shaped doctor space for a substance 5, a substrate web 8 being passed centrally through the substance space. Thus, in simple manner a two-sided application to the substrate web 8 is brought about. With its magnetic device 2, the pressing unit 4 constitutes an independent magnetic force source, which magnetically detects the magnetizable countermember 6, so that the working edge 30 of doctor 31 is pressed against the working edge of doctor 62.

FIG. 3 shows an application apparatus 1 with juxtaposed segments 20 of a magnetic device 2 over the application width 7. Each segment 20 is held by means of a swivel arm 211 forming a holding part 21, so as to swivel about a swivel axis 213 of a mounting support 210 parallel to the longitudinal direction of the apparatus 1. The segments 20 are positioned on the side of the substrate path 60 on a round bar profile doctor 32. The latter is capable of relatively bending elasticly over the application width 7 and is held as a clamping fit element in a slot 36 of each segment 20. Thus, the pressing unit 4 forms a relatively bending elastic device over the application width 7 and which as such can be adaptably pressed against a magnetizable body 6. According to FIG. 3 the latter is in the form of a steel roller. The magnetic device 2 forms the magnetic source for the magnetic pressing of the round bar doctor 32 or its working edge 30. The segments 20 can be in the form of electromagnets or permanent magnets.

FIG. 4 shows a further application apparatus 1, optionally arranged in a round stencil 9. A pressing unit 4 comprises a magnetic device 2, which is movably held in a clearance fit 212 over the application width of the apparatus. The magnetic device 2 engages loosely on a sheet or blade coating doctor 31. The clearance fit 212 is constructed in the form of a recess on a strip forming an apparatus mounting support 210 extending over the application width. The mounting support 210 also comprises a doctor holder 23. The latter is pivotable with a bearing 11 about at least one axis 12 parallel to the longitudinal direction of the apparatus 1. On the side opposite to the application apparatus 1 on the substrate path 60 is provided a pressing surface of a magnetizable body, acting as a countermember, 6 extending over the application width and on which functions the pressing unit under the action of the magnetic force of the magnetic device 2. Optionally by means of a holder 63, the body 6 is articulated so as to be movable in the direction of and/or transversely to the substrate path 60.

Figure 5:
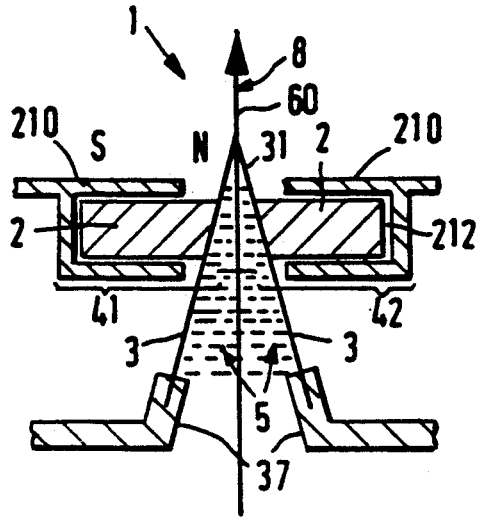
FIGS. 5 to 7 are cross-sectional views of application apparatuses according to the invention with pressing units arranged alternately to the substrate path.

FIG. 5 shows an application apparatus 1 with a pressing unit 41, 42 arranged on either side of a substrate path 60 for applying substance 5 to both sides of a substrate web 8. The pressing units 41, 42 are arranged and constructed symmetrically to the substrate path 60 of the substrate web 8. The pressing parts 3 constructed as sheet or blade-like spreading doctors 31 form a wedge-shaped substance space through which the substrate web 8 is centrally guided. The coating doctors 31 are movable in the direction of the substrate web 8 by means of alternately arranged magnetic devices 2. The magnetic devices 2 are in each case displaceably mounted in a clearance fit 212 of a mounting support 210. The loose arrangement of the magnetic devices on the pressing parts 3 corresponds to that of the embodiment of FIG. 4. The magnetic polarity of the magnetic devices 2 facing one another in alternating manner on the substrate path 6 is such that they mutually magnetically attract one another. Doctor holders 37 are arranged independently and separately from the mounting support 210 in the application apparatus 1 according to FIG. 5.

Figure 6:
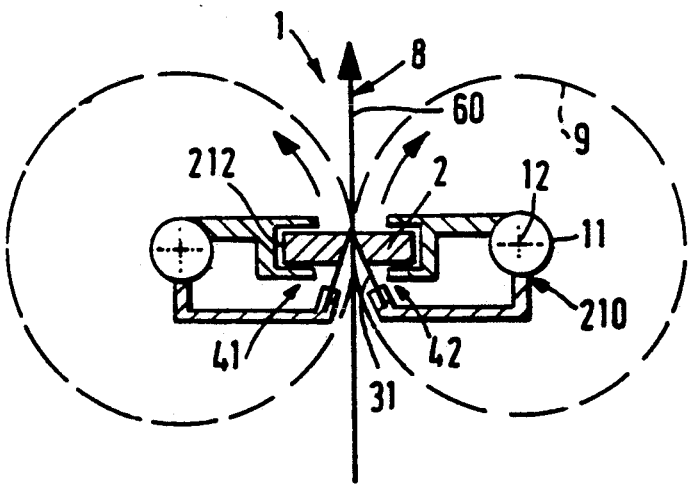

An application apparatus 1 according to FIG. 6, like that of FIG. 5, comprises two pressing units 41, 42 arranged in alternating manner on a substrate path 60 with in each case one magnetic device 2, which engages loosely on the associated sheet spreading doctor 31 and together form a magnetic pressing pair. In FIG. 6 the coating doctor 31 and clearance fit 212 are in each case provided on a common mounting support 210, which is pivotable by means of a bearing 11 about an axis 12 parallel to the longitudinal direction of the apparatus 1. The pressing units 41, 42 can in each case be arranged within a round stencil 9.

Figure 7:
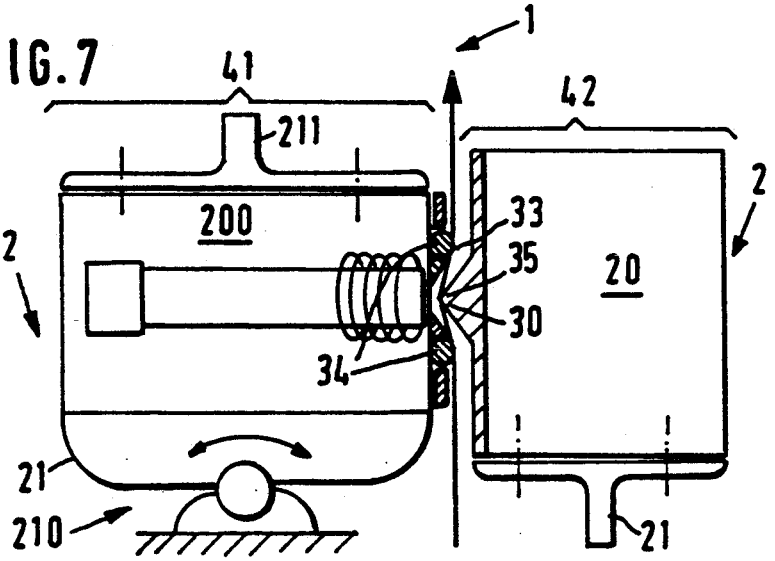

An application apparatus 1 according to FIG. 7, like that of FIG. 1, comprises on one side of the substrate path a pressing unit 41 with electromagnet segments 200 juxtaposed along the application width and which are in each case articulated by means of an arm 211 or by means of a pivoting mounting support 210. On the other side of the substrate path is provided a pressing unit 42, which comprises juxtaposed electromagnets or permanent magnets 20 over the application width. Each of these segments 20 can be movable e.g. by means of an arm 21 in the direction of and/or transversely to the substrate path.

The application apparatus 1 according to FIG. 7 comprises an air knife arrangement on the substrate path. Two through, bending elastic, rodlike pressing parts 34, leaving a recess between them, are arranged along the application width on the segmented magnetic device 2 of pressing unit 41. In said recess engages an air knife 35 with a pointed or round working edge. The air knife 35 is arranged as a bending elastic pressing part, extending over the application width and arranged on the other, segmented pressing unit 42. While a preferred embodiment has been set forth along with modifications and variations to show specific advantageous details of the present invention, further embodiments, modifications and variations are contemplated within the broader aspects of the present invention, all as set forth by the spirit and scope of the following claims.

I claim:

1. A doctor apparatus for applying fluent material along an application width to a substrate, comprising:

a pressing part provided with a working edge in a longitudinal direction of the apparatus corresponding to the application width for engaging a substrate along a substrate path;

a magnetic biased actuating device for operating the pressing part having at least one magnet on the pressing part, together forming a pressing unit; and a holding part for holding the magnetic biased actuating device, the holding part being movable in a direction extending toward the substrate path.

2. Apparatus according to claim 1, wherein the holding part is disposed centrally with respect to a longitudinal direction of the magnetic biased actuating device and wherein the holding part includes a swivel bearing for movably mounting the holding part.

3. Apparatus according to claim 1, wherein the magnetic biased actuating device is subdivided in the longitudinal direction into link-like, lined-up segments forming at least two magnets and wherein at least one of the segments is located on a side of the substrate on which the pressing part is engaged and further wherein the segments are disposed in the longitudinal direction of the apparatus.

4. Apparatus according to claim 3, wherein the pressing part is constructed as a magnetizable roll doctor held in a freely rotatable manner in at least one recess provided in the segments along the application width.

5. Apparatus according to claim 3, including a mounting support movably articulating the segments transverse to the longitudinal direction of the application apparatus.

6. Apparatus according to claim 5, wherein the mounting support comprises a pivot bearing, which articulates the segments on the pressing part, and the holding part being a swivel arm.

7. Apparatus according to claim 5, wherein the mounting support comprises at least one clearance fit forming the holding part receiving the segments on the pressing part in movable manner.

8. Apparatus according to claim 5, including a bearing supporting the mounting support to be movable in a direction toward the substrate path.

9. Apparatus according to claim 5, including a bearing supporting the pressing part to be articulated to the mounting support.

10. Apparatus according to claim 1, including a mounting support movably articulating the magnetic biased actuating device transverse to the longitudinal direction of the application apparatus.

11. Apparatus according to claim 10, wherein the mounting support comprises a pivot bearing, which articulates the magnetic biased actuating device on the pressing part, and the holding part being a swivel arm.

12. Apparatus according to claim 10, wherein the mounting support comprises at least one clearance fit forming the holding part receiving the magnetic biased actuating device on the pressing part in movable manner.

13. Apparatus according to claim 10, including a bearing supporting the mounting support to be movable in a direction toward the substrate path.

14. Apparatus according to claim 10, including a bearing supporting the pressing part to be articulated to the mounting support.

15. Apparatus according to claim 1, wherein the magnetic biased actuating device is arranged with loose engagement on the pressing part to be movable relative to the latter, the pressing part being constructed as a spreading doctor.

16. Apparatus according to claim 1, wherein each segment is arranged with loose engagement on the pressing part to be movable relative to the latter, the pressing part being constructed as a spreading doctor.

17. Apparatus according to claim 1, wherein the pressing part is constructed as a rod-like doctor.

18. Apparatus according to claim 1, wherein the pressing part is constructed as a magnetizable roll doctor held in a freely rotatable manner in at least one recess provided on the magnetic biased actuating device along the application width.

19. Apparatus according to claim 1, including a recess on the magnetic biased actuating device along the application width with two parallel pressing parts on each side of the recess.

20. Apparatus according to claim 19, including a counterengagement member, and a doctor extending along the application width of the counterengagement member opposite the recess forming an air knife arrangement.

21. Apparatus according to claim 1, including a body made from magnetizable material mounted as a countersupport for the edge of a pressing part.

22. Apparatus according to claim 21, wherein the countersupport is a roller.

23. Apparatus according to claim 1, including two said pressing units arranged in sequential manner on the substrate path and formed in each case with at least one pressing part and with a magnetizable actuating part arranged thereon and subdivided in the longitudinal direction of the apparatus into at least two segments at least one edge of the pressing part is movable transversely to the substrate path, and at least one pressing unit is constructed with the magnetic biased actuating device having at least one magnet, arranged on the associated pressing part and forming the actuating part.

24. Apparatus according to claim 1, wherein the magnetic biased actuating device is arranged on the pressing part and is a magnet, said pressing part having a first doctor, said apparatus includes a stationary countermember having a magnetic beam and a second doctor, and said first and second doctors form a pair of doctors extending in the substrate path.

* * * * *